US009303382B2

(12) United States Patent
Cassidy

(10) Patent No.: US 9,303,382 B2
(45) Date of Patent: Apr. 5, 2016

(54) COLLAR FOR MARINE PILE REPAIR AND METHOD OF USING THE SAME

(71) Applicant: BOSWELL ENGINEERING, INC., South Hackensack, NJ (US)

(72) Inventor: Dennis P. Cassidy, Hewitt, NJ (US)

(73) Assignee: BOSWELL ENGINEERING, INC., South Hackensack, NJ (US)

( * ) Notice: Subject to any disclaimer, the term of this patent is extended or adjusted under 35 U.S.C. 154(b) by 0 days.

(21) Appl. No.: 14/528,387

(22) Filed: Oct. 30, 2014

(65) Prior Publication Data

US 2015/0117959 A1 Apr. 30, 2015

Related U.S. Application Data

(60) Provisional application No. 61/898,289, filed on Oct. 31, 2013.

(51) Int. Cl.

| | |
|---|---|
| ***E02D 37/00*** | (2006.01) |
| ***E02D 13/00*** | (2006.01) |
| ***E02D 5/64*** | (2006.01) |
| ***E02D 19/02*** | (2006.01) |
| ***E02D 29/09*** | (2006.01) |

(52) U.S. Cl.

CPC ..... *E02D 37/00* (2013.01); *E02D 5/64* (2013.01); *E02D 13/00* (2013.01); *E02D 19/02* (2013.01); *E02D 29/06* (2013.01); *E02D 2250/003* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,470,149 | A | 5/1949 | Derby | |
| 3,338,058 | A * | 8/1967 | Young | E02D 5/64 249/1 |
| 3,505,825 | A * | 4/1970 | Colby | E02D 5/64 249/90 |
| 3,708,146 | A * | 1/1973 | Lamberton | E02D 5/64 249/1 |
| 4,019,301 | A | 4/1977 | Fox | |
| 4,023,374 | A | 5/1977 | Colbert et al. | |
| 4,068,483 | A * | 1/1978 | Papworth | E02D 5/60 264/32 |
| 4,116,013 | A * | 9/1978 | Hellmers | E02D 5/64 405/216 |
| 4,306,821 | A | 12/1981 | Moore | |
| 4,764,054 | A | 8/1988 | Sutton | |
| 4,983,072 | A | 1/1991 | Bell, Jr. | |
| 4,993,876 | A | 2/1991 | Snow et al. | |

(Continued)

OTHER PUBLICATIONS

Design U.S. Appl. No. 29/471,438, filed Oct. 31, 2013.

*Primary Examiner* — Benjamin Fiorello
*Assistant Examiner* — Kyle Armstrong
(74) *Attorney, Agent, or Firm* — Greenberg Traurig, LLP

(57) ABSTRACT

A collar for repairing a marine support has a tubular upper segment, a tubular lower segment, and a middle segment providing a transition region between the upper and lower segments. The collar can be opened and closed along a slit extending from the upper end of the collar to the lower end of the collar. To repair a marine support, the collar is opened and positioned so as to surround the marine pile and the extension. The collar is then closed and secured along the slit. The upper end of the collar is secured to the extension, and the lower end of the collar is secured closely along the perimeter of the pile. A flowable fill material is then injected into spaces between the collar and the marine support, filling or encasing voids or damaged areas on the marine support.

19 Claims, 10 Drawing Sheets

(56) References Cited

U.S. PATENT DOCUMENTS

| | | | |
|---|---|---|---|
| 5,919,004 | A | 7/1999 | Christenson |
| 6,536,991 | B1 | 3/2003 | Trader et al. |
| 6,773,206 | B2 | 8/2004 | Bradley et al. |
| 7,300,229 | B1 | 11/2007 | Fyfe et al. |
| 2003/0085482 | A1 | 5/2003 | Sincock et al. |

* cited by examiner

COLLAR FOR MARINE PILE REPAIR AND METHOD OF USING THE SAME

CROSS-REFERENCE TO RELATED APPLICATIONS

The present application claims the benefit of U.S. Provisional Patent Application No. 61/898,289, filed on Oct. 31, 2013, the disclosure of which is incorporated by reference herein.

FIELD OF THE INVENTION

The present invention relates to the repair and protection of marine piles, and, more specifically, to forms and methods for in situ repair of such piles through the use of injectable materials.

BACKGROUND OF INVENTION

Piles, also known as "pilings", have been used in marine environments for many years as structural supports for piers, wharves, bridges, roadways, and other constructions. Usually, such marine piles are made of concrete, steel, or wood, or combinations of such materials. All of these materials are subject to corrosion or deterioration through exposure to the marine environment, which can weaken the piles to the point of failure. Wooden piles, in particular, are subject to attack by marine organisms (e.g., plants, gribbles, shipworms, etc.), which, along with corrosion of bolts and other fixtures attached to the wood, accelerate the deterioration of the piles.

For many types of structures, the piles are capped with a concrete extension that may rest on, or surround, the upper portion of the pile. Typically, any gaps between the pile and the extension are filled with concrete, a grout, an epoxy, or other material that prevents movement or dislocation of the pile, and provides a seal against the infiltration of water. In cases where the gaps are not completely filled, or in cases where the fill material deteriorates and falls away, water can flow into the gap, providing entry for marine organisms, or allowing deterioration through contact with the water.

As the pile, extension, and/or connection become damaged or deteriorated, they lose structural strength. In severe cases, the pile may become sprung from the extension, rendering the marine support incapable of bearing any load.

SUMMARY OF INVENTION

In an embodiment, the present invention comprises a collar that surrounds a portion of a pile and a portion of an extension where the pile and extension are joined, and allows the injection of a grout, epoxy, or similar filling material between the collar and the pile and extension. The collar has an upper segment formed of a continuous sheet and arranged to surround the extension with a gap between the upper segment and the extension, and a lower segment formed of a continuous sheet joined to the upper segment and arranged to surround the pile with a gap between the lower segment and the pile. In some embodiments, the upper and lower segments may be joined to each other by a middle segment formed of a continuous sheet which provides a transition between the upper and lower segments. In some embodiments, the continuous sheets of the upper, lower, and/or middle segments are made from a flexible fabric.

In some embodiments, the entire collar opens along a slit extending from the upper end of the collar to the lower end of the collar. In some embodiments, the slit is opened and closed by means of a closing mechanism extending at least the entire length of the slit. In some embodiments, the closing mechanism is a zipper. In some embodiments, the collar is provided with a support strap at the upper end of the collar. In some embodiments, the collar is provided with funnels through which the grout, epoxy, or similar repair material may be injected into the gaps between the collar and the extension and pile.

In a method according to an embodiment of the invention, deteriorated and/or damaged material are removed from a pile and/or extension using tools, water jets, or other means. An opened collar is then positioned on the pile and adjacent extension such that the upper segment of the collar surrounds the extension and the lower segment of the collar surrounds the pile. The upper end of the collar is closed securely along the perimeter of the extension, and the lower end of the collar is closed securely along the perimeter of the pile such that cleaned areas of the extension and pile are within the collar. In some embodiments, the upper end of the collar is secured by devices such as ratchet straps. In some embodiments, the upper end of the collar is secured by the support strap in combination with anchoring devices such as concrete anchors. In some embodiments, the lower end of the collar is secured by devices such as clamps or straps that surround the collar and pile, and secure the lower end of the collar to the pile without gaps between the lower end of the collar and the pile.

With the collar secured around the extension and pile, a flowable repair material, such as an epoxy or grout, is injected through one or more of the funnels in the collar, and manipulated such that it fills the gaps between the collar and the pile and extension. The repair material has a composition such that it hardens in place. In some embodiments, the repair material has a composition such that it flows into any gaps, spaces, or holes in the pile and extension, or gaps and spaces between the pile and extension, so as to fill such gaps, spaces, and holes. In some embodiments, the filler material has a composition such that it bonds to the material of the pile and/or extension. In some embodiments, the filler material has a composition such that it bonds to the material of the collar.

A combination according to the present invention includes: a marine pile, an extension supported by the pile, and a connection including materials used to connect the pile to the extension; a collar including a flexible fabric that surrounds a portion of the pile and a portion of the extension; and a repair material between the collar and one or more of the pile, the extension, and the connection. In some embodiments, the repair material penetrates and/or is bonded to one or more of the pile, the extension, the connection, and the fabric of the collar, thereby binding the pile, extension, connection, collar, and repair material into a composite structure.

BRIEF DESCRIPTION OF FIGURES

For a more complete understanding of the present invention, reference is made to the following detailed description of various exemplary embodiments considered in conjunction with the accompanying drawings. These drawings are not necessarily drawn to scale, and are provided to denote various features of the invention. In these drawings.

DETAILED DESCRIPTION OF INVENTION

Figure 1:
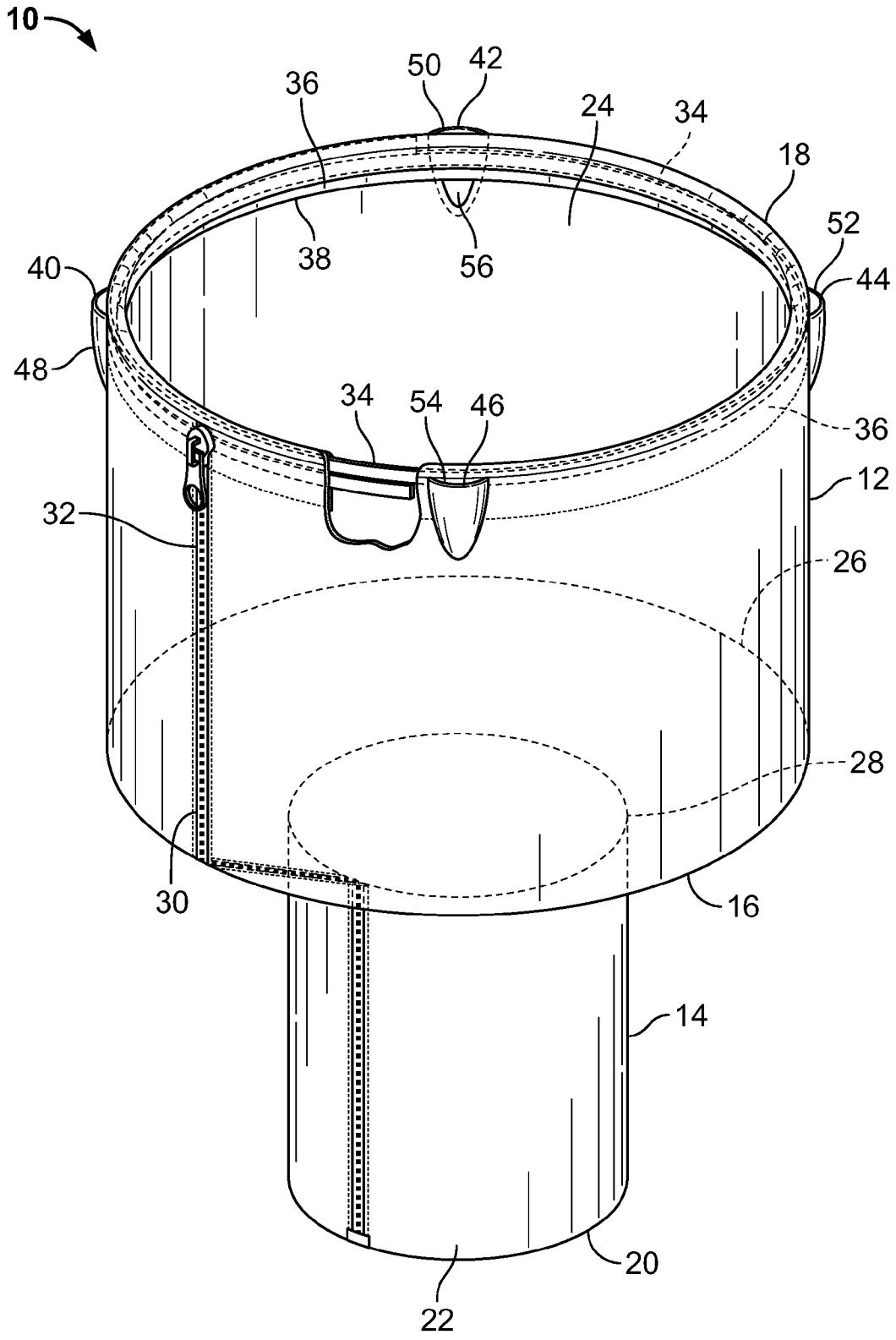
FIG. 1 is a perspective view of a collar for repair of marine supports according to an embodiment of the present invention, the collar being shown in a closed configuration and a portion of the collar being broken away to facilitate consideration and discussion.

In an embodiment, the present invention comprises a collar that surrounds a portion of a marine support, which, for the purpose of the present disclosure, includes a pile, an extension supported by the pile, and the materials connecting the pile and extension (i.e., "the connection"). The collar allows the injection of a grout, epoxy, or similar filling material between the collar and the pile and extension to fill gaps, holes, and spaces within and/or between the pile, extension, and connection.

With reference to FIGS. 1-9, there is shown a collar 10 for repair of a marine pile, an associated extension, and a connection therebetween according to a first embodiment of the present invention. The collar of FIG. 1 has an upper segment 12 arranged to surround the extension (not shown in FIGS. 1-9, but see reference number 104 in, for instance, FIG. 11) with a gap between the upper segment 12 and the extension. The collar 10 also has a lower segment 14 arranged to surround the pile (not shown in FIGS. 1-9, but see reference number 102 in, for instance, FIG. 11) with a gap between the lower segment 14 and the pile. In some embodiments of the present invention, the upper segment 12 may have a first diameter in the range of about 18 inches to about 36 inches, corresponding to a typical range of diameters for a corresponding extension, and the lower segment 14 may have a second diameter in the range of about 10 inches to about 20 inches, corresponding to a typical range of diameters for a corresponding pile. These ranges are not meant to be limiting, as the diameters of the collar 10 may be adapted (i.e., varied) so that they are usable with extensions and piles of other sizes. Further, the lengths of the upper segment 12 and lower segment 14 (in directions parallel to the longitudinal axes of the pile and extension) may be of any length that will serve to cover the sections of the pile and extension needing repair, limited only by the practicality of making and handling the collar 10 in such lengths.

With particular reference to FIGS. 1, 2 and 4-9 the upper segment 12 and the lower segment 14 are joined to each other by a middle segment 16. In the collar of FIG. 1, the middle segment 16 is arranged such that it tapers abruptly from the upper segment 12 to the lower segment 14. The upper segment 12, lower segment 14, and middle segment 16 may be made of continuous sheets of flexible fabric. The collar 10 may be manufactured such that each of the upper segment 12, lower segment 14, and middle section 16 are adapted to cover the areas of the pile and extension that are to be repaired. In alternate embodiments of the invention, the middle section 16 may be arranged such that it is substantially flat in a plane between the upper segment 12 and the lower segment 14, or tapers gradually from the upper segment 12 to the lower segment 14.

Generally, the flexible fabric used to make the collar 10 is waterproof or resistant to the penetration of water, and resistant to damage or deterioration in the marine environment. The fabric may be woven, such as a sheet of woven nylon thread or threads comprising other polymeric materials, or it may be a non-woven sheet, such as a vinyl sheet. In embodiments where a woven sheet is used, it may be coated or impregnated with a material that strengthens the fabric and/or renders it resistant to penetration by water, such as a rubberized compound. Suitable woven fabrics may also incorporate materials that provide the fabric with high tensile strength or the ability to diffuse forces from impacts to the fabric.

Referring to FIGS. 1-7, the upper segment 12 defines an upper end 18 of the collar 10, which is open. The lower segment 14 defines a lower end 20 of the collar 10, which is also open. The middle section 16 is arranged such that the interior 22 of the lower segment 14 opens into the interior 24 of the upper segment 12 and is in hydraulic communication therewith. In the embodiment of FIG. 1, the middle segment 16 is joined to the upper segment 12 and the lower segment 14 by sewn seams 26 and 28, respectively. Other methods of joining the middle segment 16 to the upper segment 12 and lower segment 14 may be used, such as heat welding or sonic welding overlapping sheets of material, or the upper segment 12, middle segment 14, and lower segment 16 may be formed as a single piece, by shaping methods known in the art.

Referring now to FIGS. 1-4 and 6-9, the collar 10 is arranged to open and close at a slit 30 that extends in a continuous fashion from the upper end 18 to the lower end 20, such that the entire collar 10 may be opened. The collar 10 may be closed securely along the slit 30 by one of more water-tight and corrosion-resistant fasteners. In the embodiment of FIG. 1, the fastener is a water-tight zipper 32 that extends the entire length of the slit 30.

Figure 2:
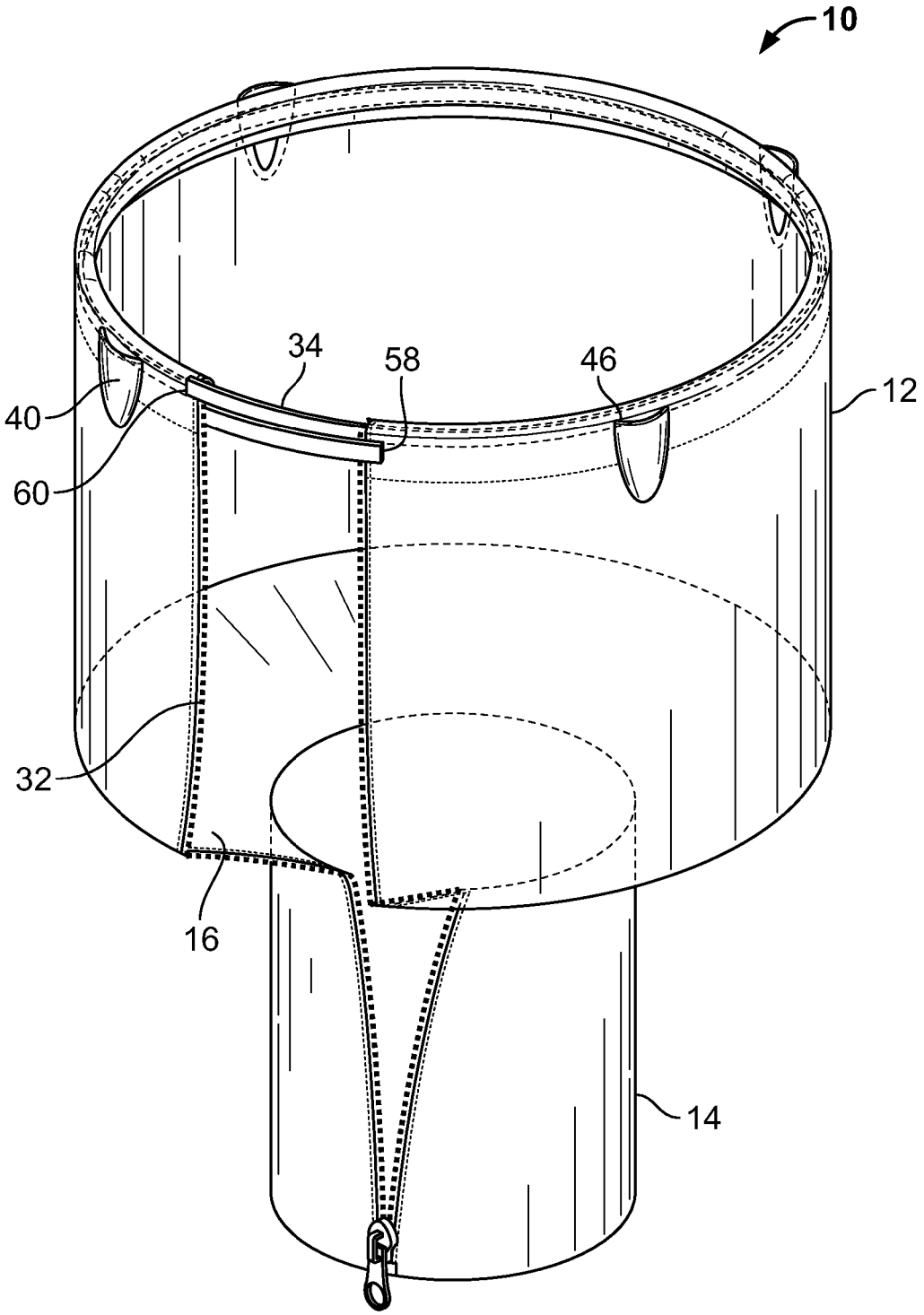
FIG. 2 is a perspective view of the collar of FIG. 1, the collar being shown in a partially opened condition.
Figure 3:
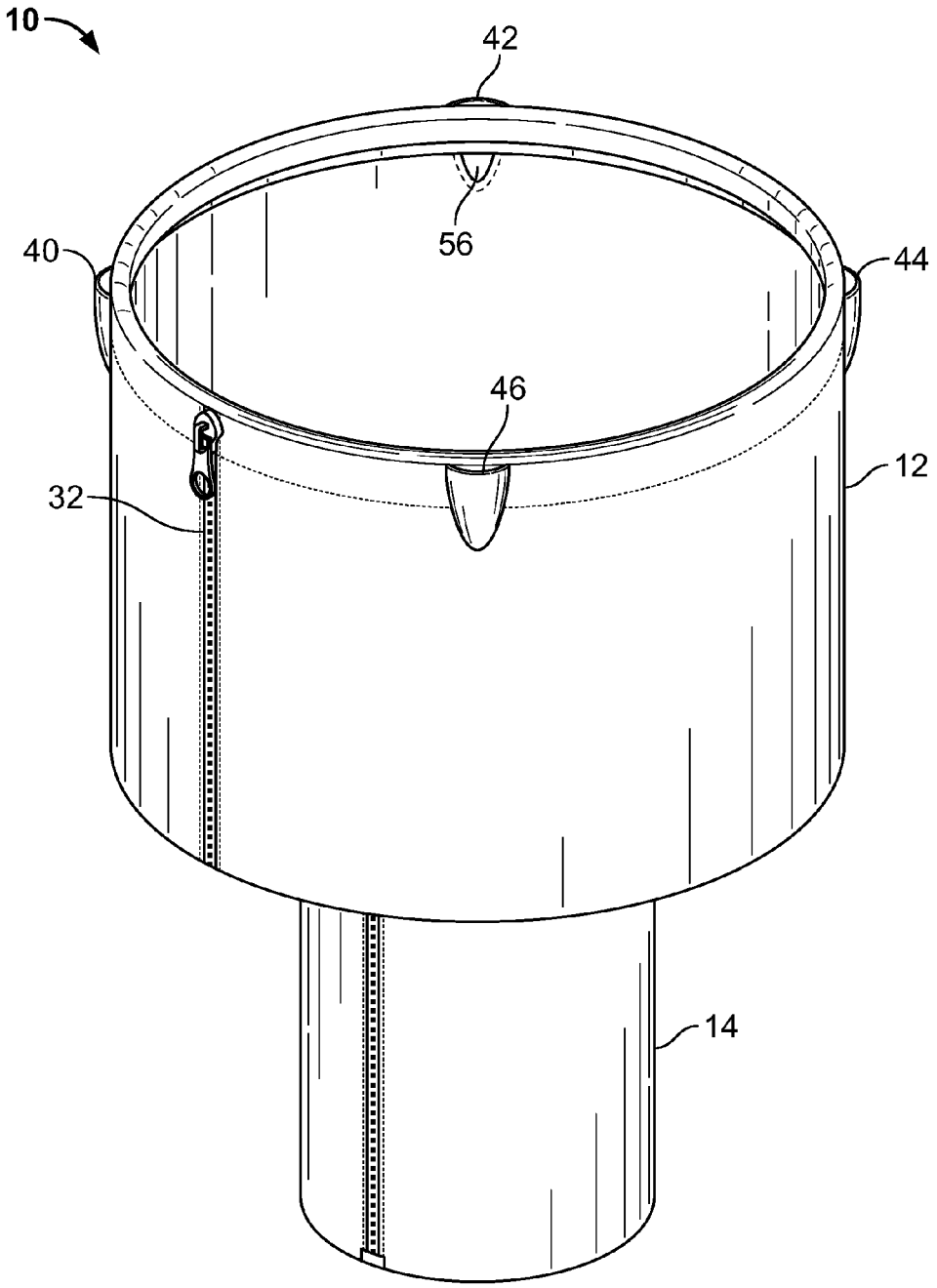
FIG. 3 is another perspective view of the collar of FIG. 1.
Figure 4:
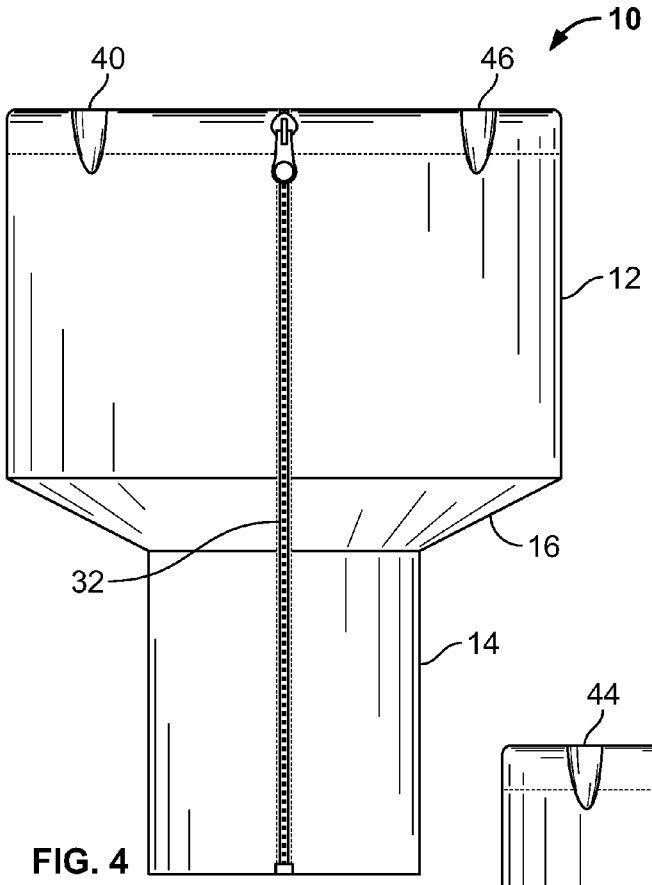
FIG. 4 is a front elevational view of the collar of FIG. 1.
Figure 5:
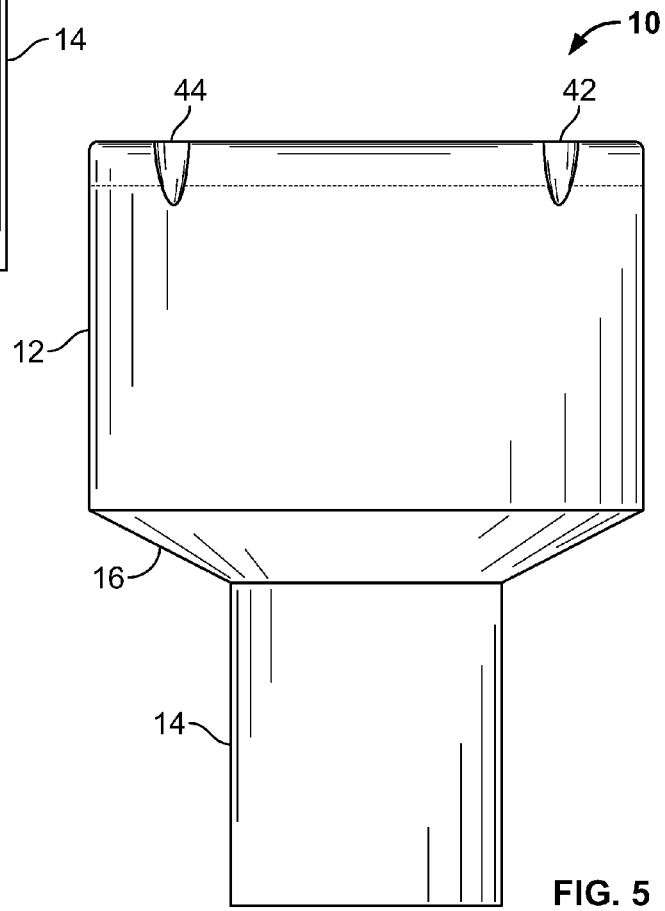
FIG. 5 is a rear elevational view of the collar of FIG. 1.
Figure 6:
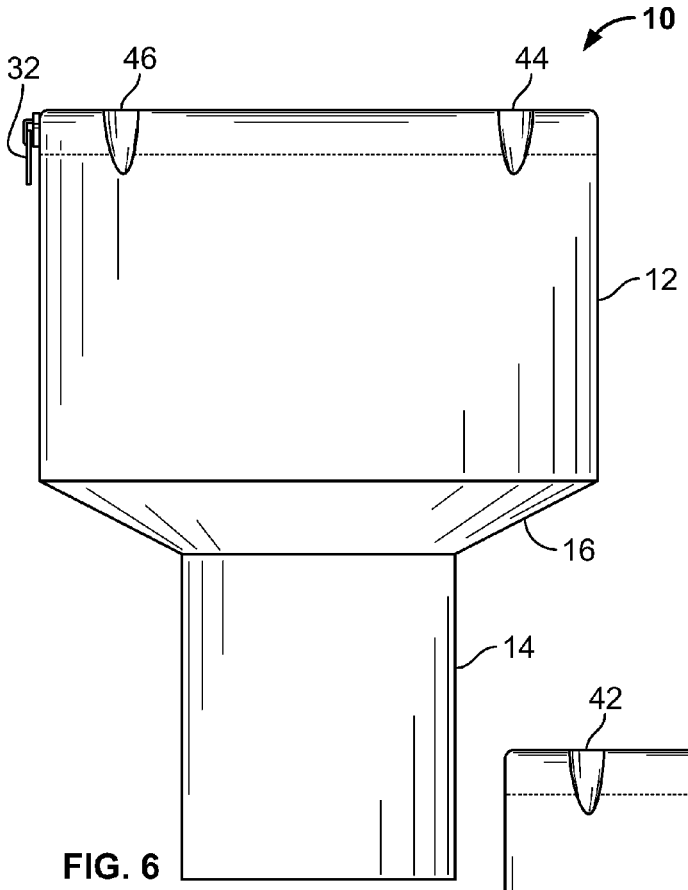
FIG. 6 is a right-side elevational view of the collar of FIG. 1.
Figure 7:
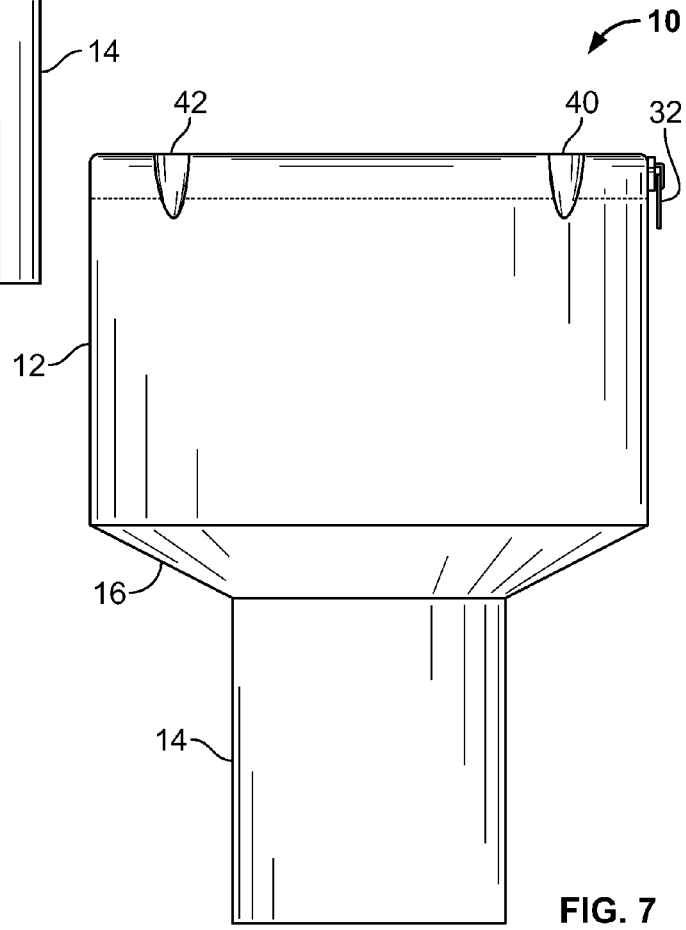
FIG. 7 is a left-side elevational view of the collar of FIG. 1.
Figure 8:
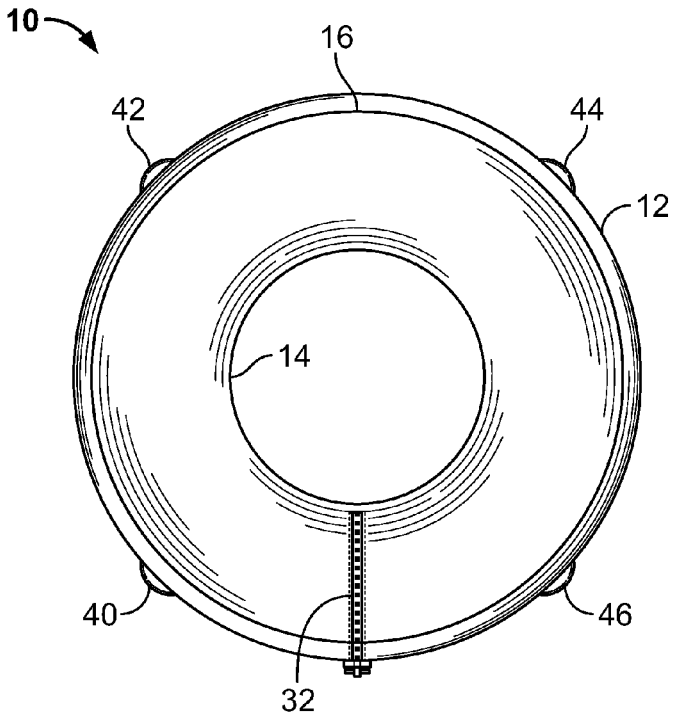
FIG. 8 is a top view of the collar of FIG. 1.
Figure 9:
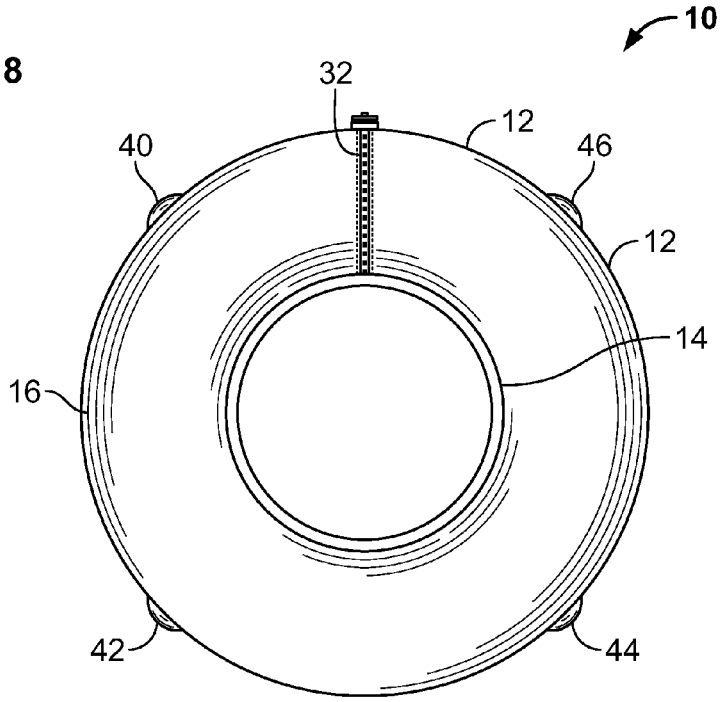
FIG. 9 is a bottom view of the collar of FIG. 1.

With particular reference to FIGS. 1 and 2, the collar 10 is provided with a support strap 34 at the upper end 18 of the collar 10. The support strap 34 maintains the shape of the upper end 18, and may be adjustable to secure the upper segment 12 against the extension during repair of the pile, extension, and connection. The support strap 34 may be a strip of spring material, such as metal, that is sufficiently long and flexible such that the support strap 34 may be bent into a shape (e.g., circular) that conforms to the shape of the upper end 18 of the collar 10. In the embodiment of FIGS. 1 and 2, the length of the support strap 34 is greater than the length of the perimeter of the upper end 18. In some embodiments, the support strap 34 is made from metal (e.g., a corrosion-resistant metal, such as stainless steel), but other materials, such as reinforced plastics, may be used instead.

The support strap 34 is secured within the collar 10 by a flap 36. The flap 36 is positioned to at least partially cover the support strap 34, and secured to the upper segment 12. The edge 38 of the flap 36 may be secured to the fabric of the upper segment 12 by sewing, or other means of securing the flap 36 may be used. The flap 36 may be an extension of the fabric of the upper segment 12, or may be a continuous strip of fabric folded over the support strap 34 at the perimeter of the upper end 18. In the embodiment of FIG. 1, a single continuous flap 36 is shown, but two or more flaps, or strips of fabric positioned along the perimeter of the upper end 18, may be used in other embodiments of the invention.

The collar 10 is provided with means by which flowable repair materials, such as grout or epoxy, may be delivered into the interior of the collar 10 during a repair operation carried out according to an embodiment of the present invention. Continuing to refer to FIGS. 1-9, one such means is a plurality of funnels, such as funnels 40, 42, 44, 46, provided around the perimeter of the upper end 18. In the embodiment of FIGS. 1-9, the funnels 40, 42, 44, 46 are similarly constructed, each having a pocket (such as pockets 48, 50, 52, 54, respectively) secured to the outside of upper end 18 (e.g., by sewing), and an opening, such as opening 56 of funnel 42. The pocket (e.g., pocket 50) and the opening (e.g., opening 56) are arranged to provide hydraulic communication between the interior of the upper segment 12 and the environment external to the collar 10, or to allow the end of an injection tube (not shown) to be inserted into the interior of the collar 10. Although four funnels 40, 42, 44, 46 are shown in FIGS. 1-9, any number of funnels may be used as is appropriate to the size of the collar 10, the properties of the repair material to be used, and the amount of repair material to be delivered.

With particular reference to FIG. 2, the collar 10 is shown with the zipper 32 unzipped and the collar 10 in a partially opened condition. In such a condition, free ends 58, 60 of the support strap 34 are withdrawn from beneath the flap 36. In the embodiment of FIG. 2, the support strap 34 is longer than the perimeter of the upper end 18, such that, when inserted under the flap 36, the free ends 58, 60 may extend to the funnels 40, 46.

Figure 10:
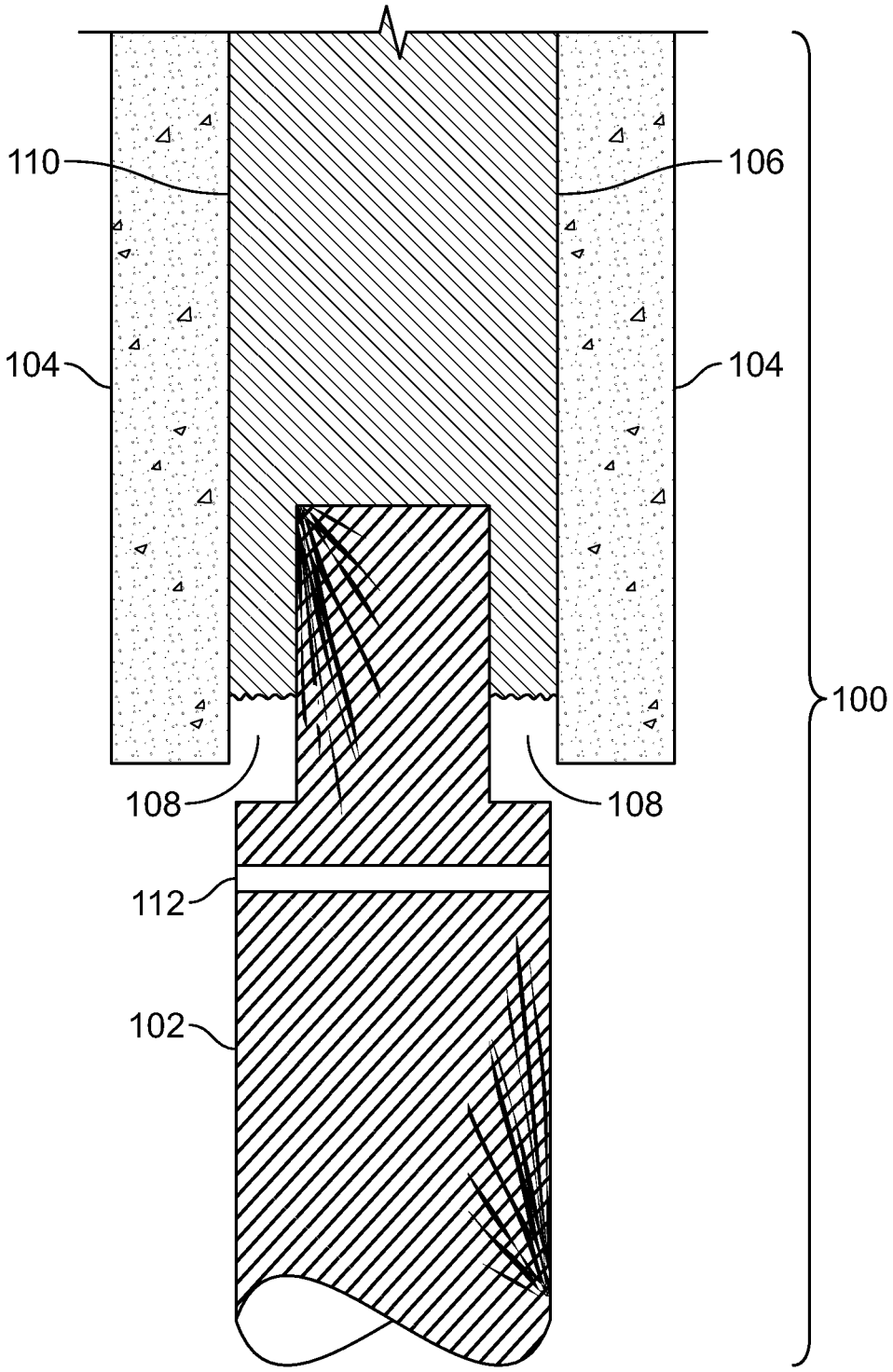
FIG. 10 is a vertical cross-sectional view of a marine support comprising a pile and a concrete extension.

Turning now to FIG. 10, an exemplary marine support 100 includes a pile 102, a concrete extension 104, and a connection 106 between the pile 102 and extension 104 after preparation for repair according to embodiments of the present invention. As may occur during the original installation, or from removal of damaged or deteriorated material, there is a hollowed-out space 108 in the pre-existing concrete fill 110 between the pile 102 and extension 104, and an open bolt hole 112 through the pile 102. Other defects that may be present in existing piles and extensions, include, but are not necessarily limited to cracks, gaps or eroded volumes in the piles or extensions themselves, holes from boring insects or marine life, openings left by corroded fixtures, etc.

Figure 11:
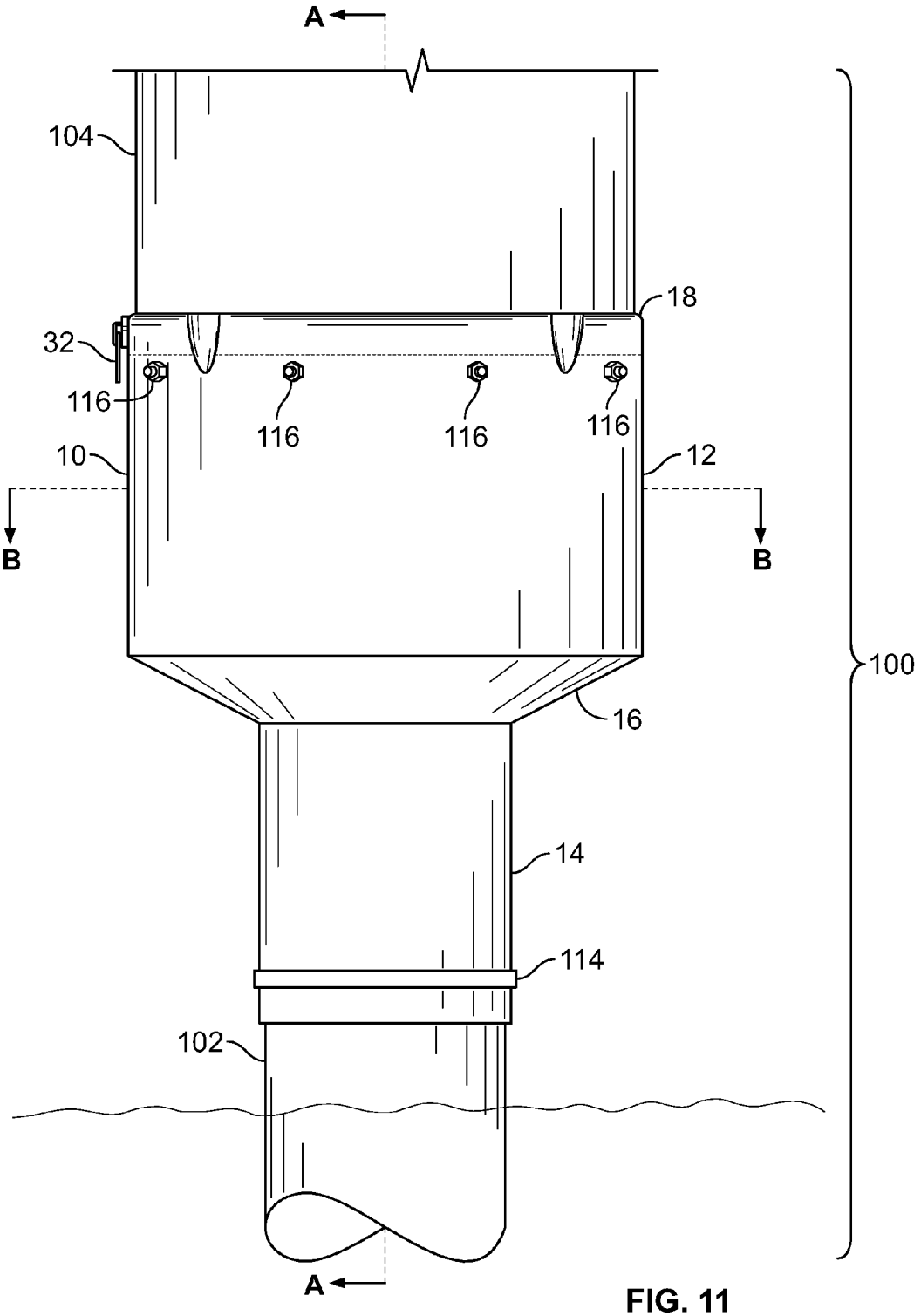
FIG. 11 is an elevational view of the marine support of FIG. 10 with a collar of the present invention after completion of a repair operation, the collar and the repaired marine support being embodiments of the present invention.

Turning now to FIG. 11, the marine support 100 has been repaired using a collar 10 and method of the present invention. Pile 102 and extension 104 are visible, as is a strap 114 used to close the lower end 20 of the collar 10 against the pile 102. Anchor bolts 116 may also be seen securing the upper end 18 of the collar 10 to the extension 104. Referring to the method and resulting composite structure generally, the materials and fabrication of the collar, and the other materials and techniques used in the method of repair may, in some embodiments, be such that the collar 10 is installed under low tide conditions at geographic locations where the collar 10 is normally partially or completely submerged at high tide.

Figure 12:
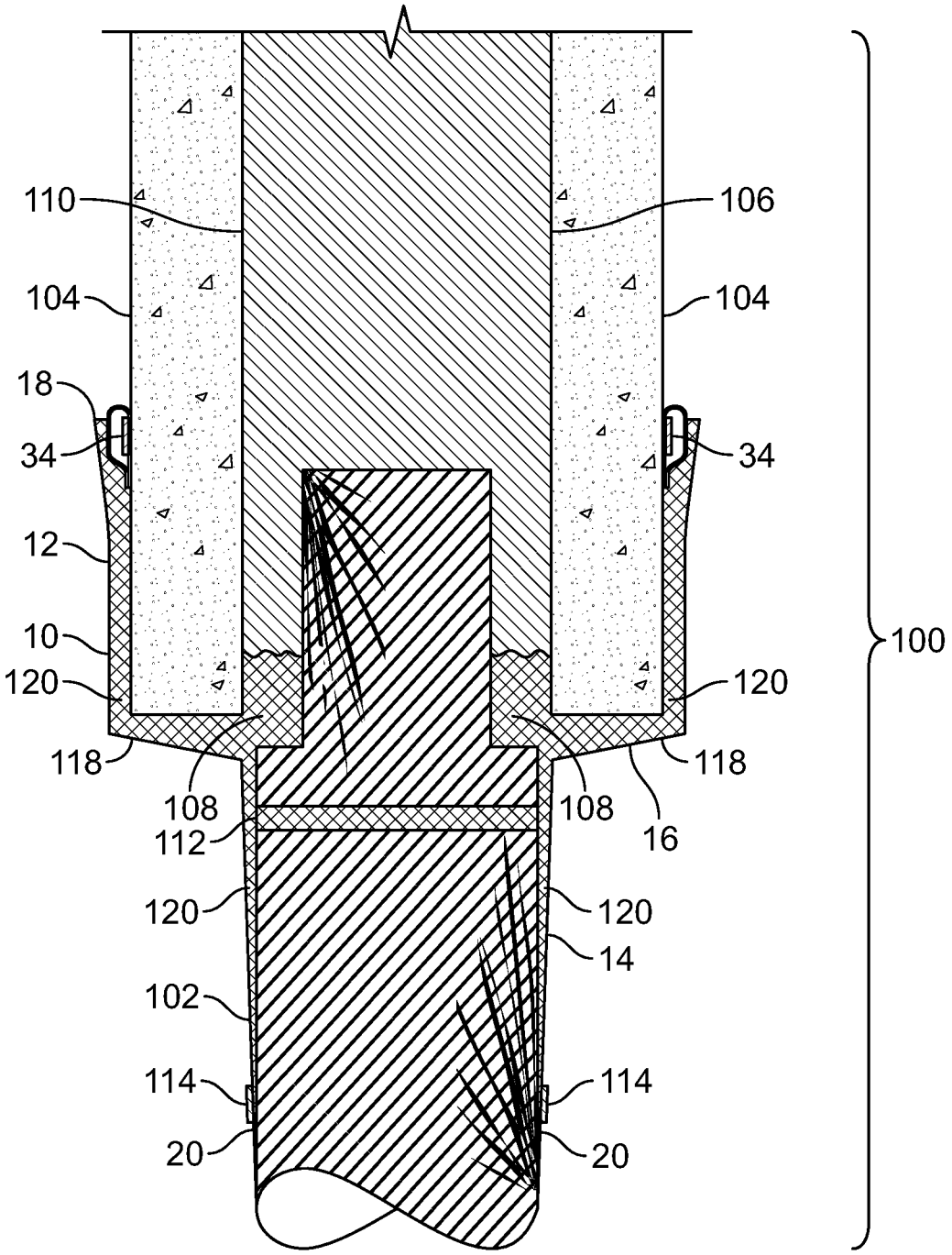
FIG. 12 is a cross-sectional view taken through sectional line A-A of the marine support of FIG. 11.
Figure 13:
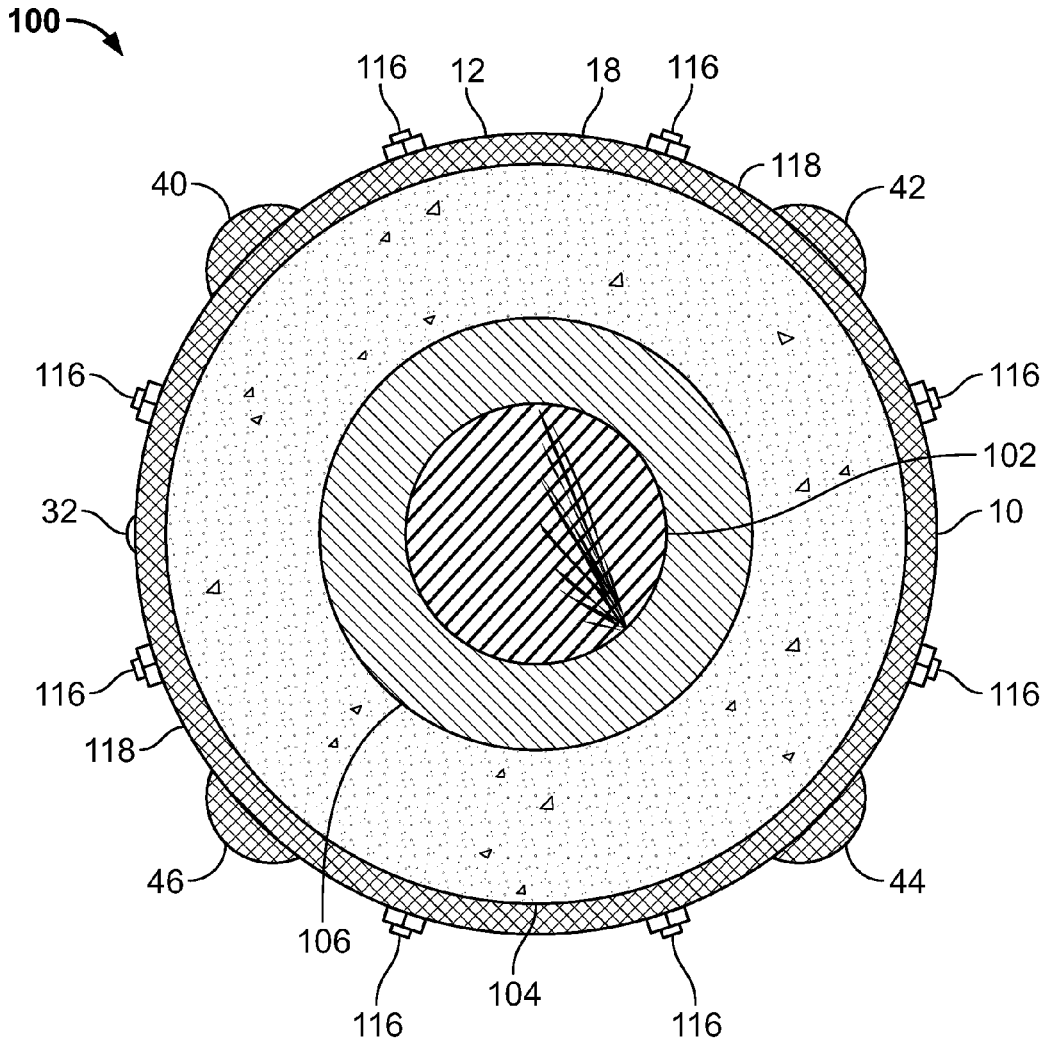
FIG. 13 is a cross-sectional view taken through sectional line B-B of the marine support of FIG. 11.

A repair method performed in accordance with the present invention, as well as the resulting composite structure of the repaired marine support 100, are discussed herein with respect to the cross-sectional views of the repaired marine support in FIGS. 12 and 13. In the repair method of the present invention, deteriorated or damaged materials (not shown) are removed from the pile 102, extension 104, and connection 106 by methods known in the art (e.g., abrasion or cutting with manual or power tools, or the use of water jets). The collar 10 is then placed around the pile 102 and extension 104, and closed using the zipper 32 or other means (not shown) for closing the collar 10, as discussed with respect to FIGS. 1 and 2. The collar 10 of FIGS. 12 and 13 has been fabricated such that the upper segment 12 and lower segment 14 cover the full extent of the damaged or deteriorated areas of the pile 102, extension 104, and connection 106 that are to be repaired.

After the collar 10 has been closed around the pile 102 and extension 104, the upper end 18 of the collar 10 is closed securely (e.g., by tightening the support strap 34) along the perimeter of the extension 104, and the lower end 20 of the collar 10 is closed securely along the perimeter of the pile 102.

The upper end 18 of the collar 10 may be secured to the extension 104 by the concrete anchor bolts 116. Other suitable securing devices (e.g., ratchet straps, screw anchors, clamps, and powder-actuated fasteners, etc.) are known in the art and may be used in combination with, or instead of, the anchor bolts 116. The securing or attachment devices may be of types that permanently secure the upper end 18 of the collar 10 to the extension 104, or they may be of types that may be removed from the collar 10 and/or extension 104 once the repair is completed. The securing means may allow gaps (not shown) between the upper end 18 of the collar 10, such that air or water displaced by the placement of fill material 110 between collar 10 and the pile 102 and extension 104 may exit the interior of the collar 10. The securing devices, such as the anchor bolts 116, may be placed below the support strap 34, so that they support the support strap 34, which distributes the weight of the collar 10 and repair material 118.

The lower end 20 of the collar 10 is secured against the pile 102 by the strap 114, such that the lower end 20 of the collar 10 is securely held against the perimeter of the pile 102, without gaps. Other securing means which may be used include clamps, ratchet straps, hose clamps, tie straps, tensioning straps, etc. The securing means, such as the strap 114, and the lower end 20 of the collar 10 may be arranged such that they will bear the weight of the repair material 118 without allowing leakage of the repair material 118 or damaging the lower end 20 of the collar 10. The strap 114 and/or other securing means may be of a type that can be left in place after the repair of the pile 102 and extension 104 has been completed.

When the upper end 18 and lower end 20 of the collar 10 have been secured around the extension 104 and pile 102, the repair material (e.g., an epoxy or grout) is delivered in a flowable state into a gap 120 formed between the collar 10 and the pile 102 and extension 104 through one or more of the funnels 40, 42, 44, 46 present around the perimeter of the upper end 18 of the collar 10. The flowable repair material 118 may be delivered into the gap 120 by gravity-driven flow through the funnels 40, 42, 44, 46, or by other means, which may include gravity-driven flow through tubes (not shown) inserted into the gap 120 through the funnels 40, 42, 46, 48, or positive-pressure injection through such tubes.

The repair material 118 has such a composition that it hardens in place. While the repair material 118 is still flowable (i.e., before it hardens), it is manipulated into place by hand or by tools to fill the gap 120 from the lower end 20 of the collar 10 to the upper end 18 of the collar 10. The composition of the repair material 118 may be such that, while still in a flowable state, the repair material flows into any gaps, spaces, or holes in the pile 102, extension 104, or connection 106, so as to fill such gaps, spaces, or holes (e.g., bolt hole 112 or the hollowed-out space 108). When the repair material 118 has hardened, it provides structural strength to the marine support 100 by strengthening the pile 102 and/or extension 104, and the connection 106 between the pile 102 and the extension 104.

In some embodiments, the repair material 118 penetrates and/or bonds with the material of the pile 102. In some embodiments, the repair material 118 penetrates and/or bonds with the material of the extension 104. In some embodiments, the repair material 118 penetrates and/or bonds with the fabric of the collar 10. Such bonding may occur through chemical bonding between the repair material 118 and the fabric of the collar 10. Suitable repair materials may have one or more of the following properties: high strength (e.g., compressive strength, tensile strength, shear strength, compressive strength, etc.); low viscosity in its flowable form; early high strength and adhesive ability; low heat build-up while hardening; non-corrosive to the materials of the collar 10 or marine support 100; freeze and thaw resistant; and little to no shrinkage while hardening. A suitable grout for use in the present invention is SikaGrout® 300 PT (Sika Corporation, 201 Polito Avenue, Lyndhurst, N.J. 07071). A suitable epoxy for use in the present invention is Sikadur® 35, Hi-Mod LV (Sika Corporation, 201 Polito Avenue, Lyndhurst, N.J. 07071). Methods of preparing and handling such grouts and epoxies in the field are known in the art.

Continuing to refer to FIGS. 12 and 13, in an embodiment of the present invention, the repaired support 100 comprises the pile 102, the extension 104, the connection 106, the collar 10, and the repair material 118 in combination. In some embodiments of the combination, the collar 10 is fabricated and placed such that the upper segment 12 and lower segment 14 of the collar 10 cover the full extent of the damaged or deteriorated areas of the extension 104 or pile 102. The repaired support 100 may include the support strap 34 and the auxiliary securing means, such as the anchor bolts 116, for the upper end 18 of the collar 10. The repaired support 100 may also include the securing means, such as the strap 114, for the lower end 20 of the collar 10. In some embodiments, the repair material 118 penetrates and/or is bonded to one or more of the pile 102, the extension 104, the connection 106, and the fabric of the collar 10, thereby binding the pile 102, extension 104, connection 106, collar 10, and repair material 118 into a composite structure.

The collar 10 and the method of the present invention may be used with piles and/or extensions of timber, concrete, metal, or other structural materials. The flexibility of the collar 10, as well as the flowability of the repair material, allow the collar 10 and the method of the present invention to be used to repair marine supports where the pile has become displaced such that it is no longer centered in the extension, or where the pile was originally installed off center. Further, although FIGS. 1, 8, 9, and 11 show the upper segment 12 and lower segment 14 of the collar 10 as having circular cross-sections, the collar 10 can readily be fabricated to accommodate piles and extensions having non-circular cross-sections by shaping the upper segment 12, lower segment 12, middle segment 16, and/or the support strap 34 to match the perimeter of the cross-section. Such cross-sections include square cross-sections, non-square rectangular cross-sections, non-circular elliptical cross-sections, and cross-sections having other regular or irregular shapes.

It should be understood that the embodiments of the invention described herein are merely exemplary and that a person skilled in the art may make many variations and modifications without departing from the spirit and scope of the invention, as described in the claims appended hereto.

I claim:

1. A collar for repairing a marine support including a marine pile and an extension upon an upper end of the marine pile, said collar being moveable from an open condition, in which said collar is positionable about the marine support, and a closed condition, in which said collar is positioned about the marine support, said collar comprising, when in said closed condition:

a tubular lower segment having a lower segment side wall defining a lower segment interior, a lower segment upper end, a lower segment lower end opposite said lower segment upper end, said lower segment lower end defining a lower end of said collar, a lower segment perimeter around said lower segment side wall proximate said lower segment upper end, and a lower segment diameter across said lower segment side wall proximate said lower segment upper end;

a tubular upper segment having an upper segment side wall defining an upper segment interior and having an upper segment perimeter which is greater than said lower segment perimeter, and an upper segment diameter which is greater than said lower segment diameter;

a conical middle segment connected to said lower end of said upper segment and said upper end of said lower segment, said middle segment providing a transition region between said upper segment and said lower segment and having a middle segment interior communicating with said lower segment interior and said upper segment interior and cooperating therewith to form a collar interior;

an imparting means for imparting a tubular shape to said upper segment of said collar, said imparting means including a strap located proximate said upper end of said collar and encircling said upper segment of said collar, said strap having a first end and a second end opposite said first end; and a supplying means, formed in said upper segment side wall, for supplying flowable fill material to said collar interior from a source outside said collar, wherein said supplying means includes an at least one first opening through said upper segment, said at least one first opening being located below said strap, and at least one funnel-shaped pocket extending across said strap and defining at least one second opening that is outside of said upper segment and is located above said strap, said at least one pocket providing access to said at least one first opening from outside of said collar through said at least one second opening.

2. The collar of claim 1, wherein said strap has a length, measured between said first end thereof and said second end thereof, that is greater than said upper segment perimeter.

3. The collar of claim 2, further comprising retaining means for retaining said first and second ends of said strap such that each of said first and second ends is reversibly removable from and insertable into said retaining means.

4. The collar of claim 1, wherein said collar is split along a line extending from said upper end of said collar to said lower end of said collar, said collar further comprising closing means for closing said collar along said line to thereby define said closed condition of said collar.

5. The collar of claim 4, wherein said closing means includes a zipper and wherein said upper, lower and middle segments of said collar are made from a fabric that resists the penetration of water when said collar is in said closed condition.

6. The collar of claim 1, wherein said at least one funnel-shaped pocket includes a plurality of funnel-shaped pockets and said at least one first opening includes a plurality of first openings.

7. A method of repairing a marine support which includes a marine pile and an extension upon an upper end of the marine pile, the marine pile and/or the extension having a damaged or deteriorated portion, said method comprising the steps of:

providing a collar including a tubular lower segment having a lower segment side wall defining a lower segment interior, a lower segment upper end, a lower segment lower end opposite the lower segment upper end, the lower segment lower end defining a lower end of the collar, a lower segment perimeter around the lower segment side wall proximate the lower segment upper end, and a lower segment diameter across the lower segment side wall proximate the lower segment upper end; a tubular upper segment having an upper segment side wall defining an upper segment interior and having an upper segment perimeter which is greater than the lower segment perimeter, and an upper segment diameter which is greater than the lower segment diameter; a conical middle segment connected to the lower end of the upper segment and the upper end of the lower segment, the middle segment providing a transition region between the upper segment and the lower segment and having a middle segment interior communicating with the lower segment interior and the upper segment interior and cooperating therewith to form a collar interior; an imparting means for imparting a tubular shape to the upper segment of said collar, the imparting means including a strap located proximate the upper end of the collar and encircling the upper segment of the collar, the strap having a first end and a second end opposite the first end; and a supplying means, formed in the upper segment side wall, for supplying fill material to the collar interior from a source outside the collar, wherein the supplying means includes at least one first opening through the upper segment, the at least one first opening being located below the strap, and at least one funnel-shaped pocket extending across the strap and defining at least one second opening that is outside of the upper segment and is located above the strap, the at least one pocket providing access to the at least one first opening from outside of the collar through the at least one second opening;

positioning the collar such that the lower segment surrounds the perimeter of the marine pile, the upper segment surrounds the perimeter of the extension, and the collar covers the damaged or deteriorated portion;

closing the collar along the line extending from the upper end of the upper segment of the collar to the lower end of the lower segment of the collar;

urging the lower segment of the collar against the marine pile along the perimeter of the marine pile;

securing the upper segment of the collar to the extension; and injecting a flowable fill material between the collar and the marine support so as to fill the damaged or deteriorated portion.

8. The method of claim 7, further comprising the step of securing the strap at a position proximate the upper end of the collar, whereby the weight of the collar and the fill material is distributed along the strap.

9. The method of claim 7, wherein the fill material is injected from a source external of the collar, through the first opening and into a void between the upper segment and the extension.

10. The method of claim 7, wherein the fill material has a composition such that the fill material hardens in place after being injected between the collar and the marine support.

11. The method of claim 7, wherein said urging step is performed by tightening a strap around the lower end of the lower segment.

12. The method of claim 7, further comprising the step of removing damaged or deteriorated material from said damaged or deteriorated portion of the marine support before said step of positioning the collar.

13. The method of claim 7, wherein the at least one funnel-shaped pocket of the collar includes a plurality of funnel-shaped pockets and the at least one first opening includes a plurality of first openings.

14. A system for repairing a marine support, comprising:

a marine support having a damaged or deteriorated portion, said marine support comprising a marine pile having an upper end and a first perimeter and an extension upon said upper end of said marine pile, said extension having a second perimeter;

a collar positioned around said marine support so as to cover said damaged or deteriorated portion thereof, said collar comprising a tubular lower segment having a lower segment side wall defining a lower segment interior, a lower segment upper end, a lower segment lower end opposite said lower segment upper end, said lower segment lower end defining a lower end of said collar, a lower segment perimeter around said lower segment side wall proximate said lower segment upper end, and a lower segment diameter across said lower segment side wall proximate said lower segment upper end;

a tubular upper segment having an upper segment side wall defining an upper segment interior and having an upper segment perimeter which is greater than said lower segment perimeter, and an upper segment diameter which is greater than said lower segment diameter;

a conical middle segment connected to said lower end of said upper segment and said upper end of said lower segment, said middle segment providing a transition region between said upper segment and said lower segment and having a middle segment interior communicating with said lower segment interior and said upper segment interior and cooperating therewith to form a collar interior;

an imparting means for imparting a tubular shape to said upper segment of said collar, said imparting means including a strap located proximate said upper end of said collar and encircling said upper segment of said collar, said strap having a first end and a second end opposite said first end; and a supplying means, formed in said upper segment side wall, for supplying fill material to said collar interior from a source outside said collar, wherein said supplying means includes at least one first opening through said upper segment side wall, said at least one first opening being located below said strap, and at least one funnel-shaped pocket extending across said strap and defining at least one second opening that is outside of said upper segment and is located above said strap, said at least one pocket providing access to said at least one first opening from outside of said collar through said at least one second opening; and a hardened fill material residing between said collar and said marine support and filling said damaged or deteriorated portion thereof.

15. The system of claim 14, wherein said strap rests on bolts penetrating said extension through said upper segment of said collar so as to support said collar.

16. The system of claim 14, further comprising urging means for urging said lower end of said lower segment against said marine pile.

17. The system of claim 14, wherein said fill material is bonded to at least one of said marine pile, said extension, or the collar and is of a type that resists degradation in a marine environment.

18. The system of claim 14, wherein said collar is made from a material that resists penetration by water and degradation in a marine environment.

19. The system of claim 14, wherein said at least one funnel-shaped pocket includes a plurality of funnel-shaped pockets and said at least one first opening includes a plurality of first openings.

* * * * *